US005902153A

United States Patent [19]

Weickenmeier et al.

[11] Patent Number: 5,902,153

[45] Date of Patent: May 11, 1999

[54] MULTI-POLE CONNECTOR HAVING MICROTEMPERATURE FUSE AND RESISTOR

[75] Inventors: Klaus Weickenmeier, Ettlingen, Germany; Claude Bleger, Duttlenheim, France; Thomas Helming, Baden-Baden, Germany

[73] Assignee: Robert Bosch GmbH, Stuttgart, Germany

[21] Appl. No.: 08/977,884

[22] Filed: Nov. 25, 1997

[30] Foreign Application Priority Data

Nov. 25, 1996 [DE] Germany ..... 1 96 48 710

[51] Int. Cl.[6] ..... H01R 13/68

[52] U.S. Cl. ..... 439/621; 439/620

[58] Field of Search ..... 439/620, 621, 439/622

[56] References Cited

U.S. PATENT DOCUMENTS

| | | | |
|---|---|---|---|
| 4,516,815 | 5/1985 | Venable et al. | 439/622 |
| 4,894,017 | 1/1990 | Stein et al. | 439/78 |
| 5,002,501 | 3/1991 | Tucker | 439/622 |
| 5,238,429 | 8/1993 | Margrave et al. | 439/620 |
| 5,266,055 | 11/1993 | Naito et al. | 439/620 |
| 5,435,754 | 7/1995 | Hotea et al. | 439/620 |

FOREIGN PATENT DOCUMENTS

| | | | |
|---|---|---|---|
| 1007275 | 3/1977 | Canada | 439/621 |
| 0 588 395 A2 | 3/1994 | European Pat. Off. . | |
| 36 11 390 C1 | 3/1987 | Germany . | |
| 42 17 205 C2 | 9/1994 | Germany . | |
| 081 38800 | 5/1996 | Japan . | |
| WO 91/13478 | 9/1991 | WIPO . | |

*Primary Examiner*—John Hilten
*Assistant Examiner*—Leslie Grohusky
*Attorney, Agent, or Firm*—Edwin E. Greigg; Ronald E. Greigg

[57] ABSTRACT

A novel plug connector is intended to improve the capability of triggering a consumer. The plug connector has a plug which has three contact blades, of which a first contact blade is connected to a first cable connection by means of a first electrical lead element, a second contact blade is connected to a second cable connection by means of a second electrical lead element, and a third contact blade is connected to the second electrical lead element by means of a third electrical lead element and via electric components; one connection cable, leading to the consumer, is soldered to each of the two cable connections. The multi-pole plug connector is especially suitable for electrically connecting an electric controller to an electric motor.

5 Claims, 2 Drawing Sheets

MULTI-POLE CONNECTOR HAVING MICROTEMPERATURE FUSE AND RESISTOR

BACKGROUND OF THE INVENTION

The invention is based on a multi-pole plug connector. A multi-pole plug connector is already known (German Patent DE 42 17 205 C2), in which two spring contacts are connected by soldering them to two separate conductor tracks of a ribbon cable, and a shielding choke is soldered into one of the conductor tracks. Such an embodiment does not allow variable triggering of an electric consumer.

OBJECT AND SUMMARY OF THE INVENTION

The multi-pole plug connector according to the invention has the advantage over the prior art that it is compact and simple in design and enables a variable triggering of the electric consumer, in particular in stages.

By the provisions recited hereinafter, advantageous further features of and improvements to the plug connector recited are possible.

It is especially advantageous for the cables leading to the electric consumer that each cable be soldered to one cable connection in an easily disconnected connection.

It is also advantageous to dispose the microtemperature fuse, contemplated as the electric component, and a coiled resistor in series on the connector housing in an easily accessible way and to protect them from being touched by a curved guard frame.

It is also advantageous for rapid assembly of the plug connector to make the connector housing of plastic and for fastening it to a carrier body to provide an S-shaped retaining tongue on the connector housing that can be inserted into a retaining opening of the carrier body and protrudes beyond the circumference thereof.

The invention will be better understood and further objects and advantages thereof will become more apparent from the ensuing detailed description of a preferred embodiment taken in is conjunction with the drawings.

DESCRIPTION OF THE PREFERRED EMBODIMENTS

Figure 1:
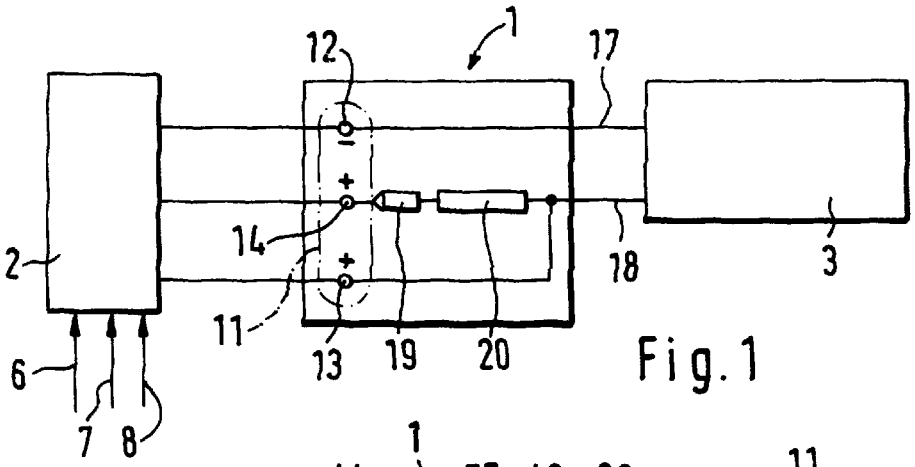
FIG. 1, in a block circuit diagram, shows an electric controller, a multi-pole plug connector, and an electric consumer.
Figure 2:
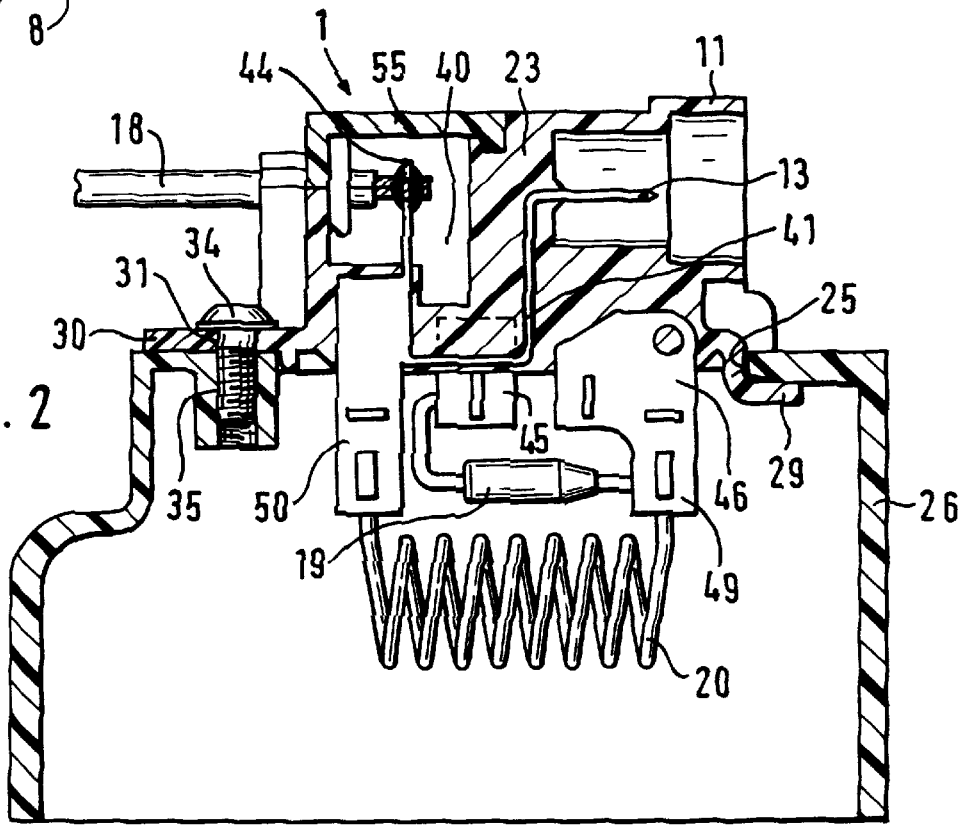
FIG. 2 shows a multi-pole plug connector embodied according to the invention, in a section taken along the line II—II of FIG. 3.

In FIG. 1, in a simplified block circuit diagram, reference numeral 1 indicates a multi-pole plug connector, which is connected electrically to an electric controller 2 and an electric consumer 3. By way of example, the electric controller 2 is an electronic control unit, which in internal combustion engines serves to receive engine operating characteristics, process them, and output control signals derived from them for triggering various electrical consumers of the engine. As examples of operating characteristics, which are ascertained for instance by sensors located outside the electrical controller 2 or the electronic control unit, the ambient temperature 6, engine coolant temperature 7, engine rpm 8, and other variables can be delivered to the electric controller 2 in the form of electrical signals. Acting as the electric consumer 3 by way of example is an electric motor for driving the radiator fan of the engine. The plug connector 1 has a plug 11, represented by dot-dashed lines, in which a first contact blade 12, a second contact blade 13 and a third contact blade 14 are provided. Each of the contact blades 12–14 is connected to the electric controller 2 via an electrical cable. A first connection cable 17 and a second connection cable 18 lead to the electric consumer 3. The first contact blade 12 is connected to the first connection cable 17, and the second contact blade 13 is connected to the second connection cable 18. The third contact blade 14 is also connected to the second connection cable 18, but with the interposition of at least one electric component, which by way of example comprises a microtemperature fuse 19 or an ohmic resistor 20, or both of them connected in series. This embodiment makes it possible for instance to trigger the electric consumer 3, in other words the electric motor, in two stages, since when the electric motor 3 is triggered by the electric controller 2 via the second contact blade 13, for instance, a higher rpm of the electric motor 3 is attained than upon triggering by the electric controller via the third contact blade 14, in which because of the interposed resistor 20 a reduction in the trigger current of the electric motor 3 leads to a reduction in the rpm of the electric motor 3. It is thus possible, using the multi-pole plug connector 1 of the invention, to cause an electric motor 3, which for instance actuates the radiator fan, to run at two different speeds, if suitable triggering by the electric controller 2 is done based on the engine operating conditions. The microtemperature fuse (MTS) 19, known per se, as the electric component serves, if a temperature acting on the microtemperature fuse and resulting from the ambient temperature and the temperature increase effected by the resistor 20 is exceeded, to interrupt the current path from the third contact blade 14 to the electric consumer 3.

Figure 5:
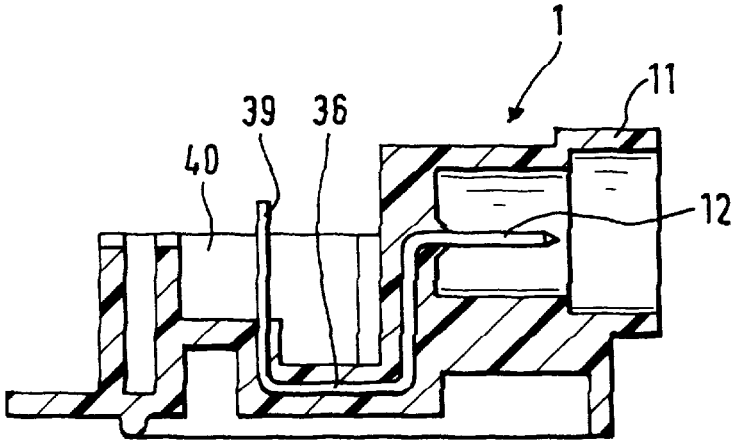
FIG. 5 shows a section taken along the line V—V of FIG. 3.
Figure 3:
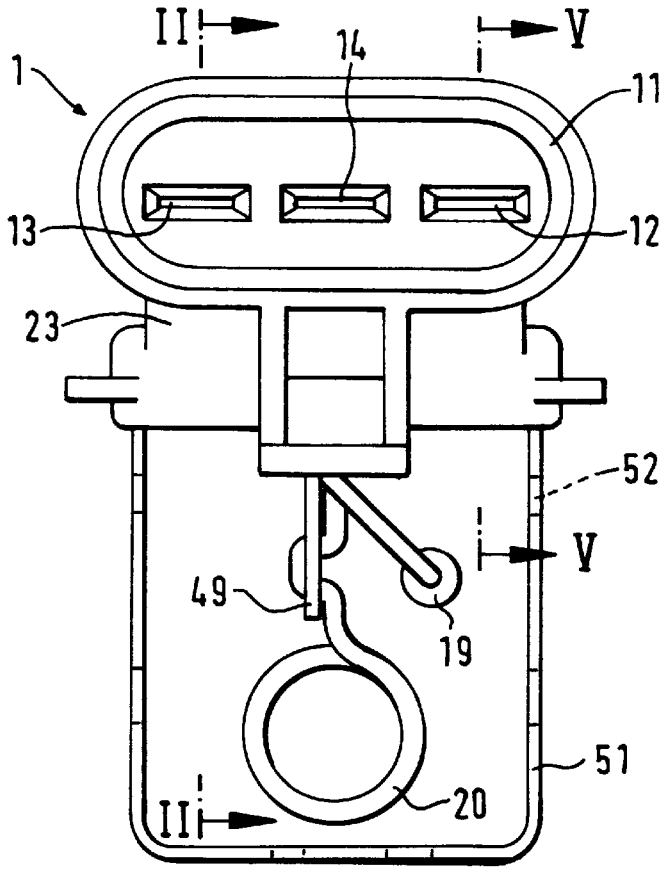
FIG. 3 shows a multi-pole plug connector of FIG. 2 in a side view.
Figure 4:
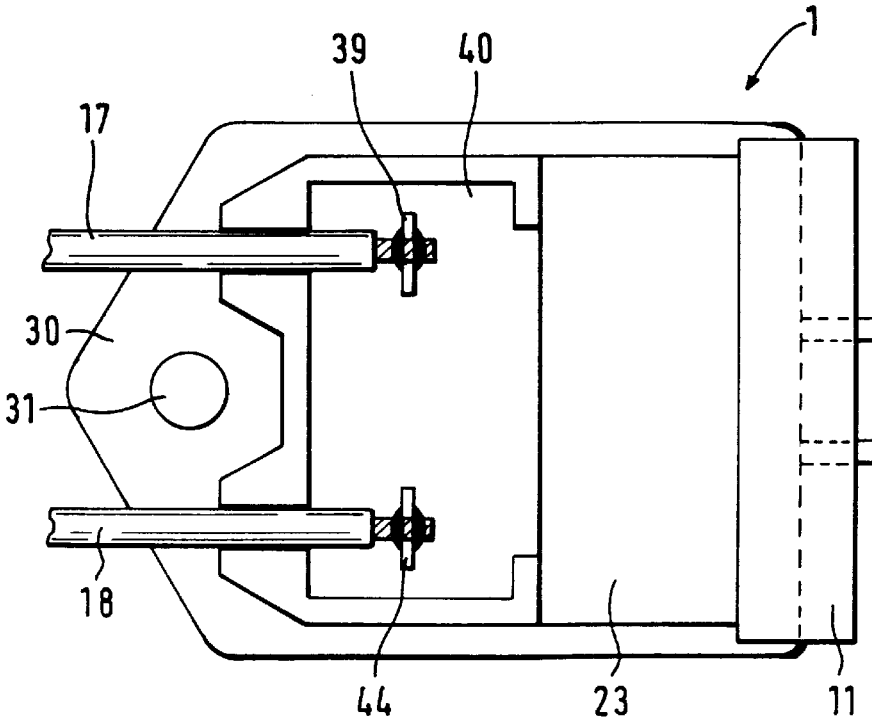
FIG. 4 shows a plan view on a multi-pole plug connector of FIG. 2 with the cap removed.

The compact design of the multi-pole plug connector 1 according to the invention will now be explained in conjunction with FIGS. 2–5. Reference numeral 23 indicates a connector housing, which is blocklike and rectangular in shape and is made from plastic. The connector housing 23 is provided with recesses, for instance reforming a plug 11. For securing the plug connector 1 in a retaining opening 25 of a carrier body 26, which body is formed by a body of a cooler fan of an internal combustion engine, the connector housing 23 has an S-shaped retaining tongue 29 on its circumference that engages the retaining opening 25 and protrudes past it to the outside. Opposite the retaining tongue 29 on the connector housing 23, a retaining flange 30 is formed, which fits over the retaining opening, 25 on the outside and has a through opening 31. After the retaining tongue 29 has been inserted into the retaining opening 25 of the carrier body 26, the plug connector 1 is fixed on the carrier body 26 by means of a screw 34, which is inserted through the through opening 31 of the retaining flange 30 and engages a threaded opening 35 of the carrier body 26. The plug 11 is provided with the first contact blade 12, the second contact blade 13, and the third contact blade 14. As shown in FIG. 5, the first contact blade 12 is electrically conductively connected to a first cable connection 39 by means of a first electrical lead element 36; the first electrical lead element 36 is embedded in the plastic of the connector housing 23, and the first cable connection 39 protrudes into a connection recess 40 of the connector housing 23. The second contact blade 13 is connected by means of a second electrical lead element 41, which is likewise embedded in the connector housing 23, to a second cable connection 44, which likewise protrudes into the connection recess 40. The third contact blade 14 is electrically connected to the second electrical lead element 41 and hence to the second cable connection 44 by means of a third electrical lead element 45, which is partly embedded in the connector housing 23, with the interposition of the series-connected microtemperature fuse 19 and the coiled resistor 20. One connection wire of the microtemperature fuse 19 is connected to the third electrical lead element 45, while the other connection wire is connected to an electrically conductive conducting body 46, which is embedded, shaped in platelike form, in the connector housing 23 and on whose free end 49, protruding out of the connector housing 23, the connection with the connection wire of the microtemperature fuse 19 and the one connection wire of the coiled resistor 20 is made. The other connection wire of the coiled resistor 20 is connected to a connecting portion 50 of the second electrical lead element 41 that protrudes out of the connector housing 23. Hence the microtemperature fuse 19 and the coiled resistor 20 are disposed outside the connector housing 23, in such a way that these two electric components 19, 20 are disposed approximately parallel to and spaced apart from one another. The connection wires of the temperature fuse 19 and of the resistor 20 are clamped or soldered to the third electrical lead element 45, connecting body 46, and connecting portion 50. To guard against unintended touching of these electric components 19, 20, a curved guard frame 51 is mounted on the connector housing 23; this frame spans the electric components 19, 20 on at least three sides and is provided by way of example with openings 52 shown in dashed lines (see FIG. 3). The first connection cable 17 is connected to the first cable connection 39, and the second connection cable 18 is connected to the second cable connection 44, in each case by soldering. The soldered connection of the connection cables 17, 18 makes it possible to replace the plug connector 1 quickly if there is a defect. To protect these soldered connections at the cable connections 39, 40 and to relieve tension on the soldering points, a cap 55 that covers the connection recess 40 is provided on the connector housing 23; in FIGS. 4 and 5, this cap has been removed.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A multi-pole plug connector for electrically connecting an electric controller to an electric consumer, comprising a connector housing, a plug with contact blades, cable connections, and having at least one electric component between one of the contact blades and one of the cable connections, the plug (11) has three contact blades (12, 13, 14), of which a first contact blade (12) is connected to a first cable connection (39) by means of a first electrical lead element (36), a second contact blade (13) is connected to a second cable connection (44) by means of a second electrical lead element (41), and a third contact blade (14) is connected to the second electrical lead element (41) by means of a third electrical lead element (45) and via a microtemperature fuse (10) and a coil-shaped resistor (20) connected in series.

2. A plug connector in accordance with claim 1, in which one connection cable (17, 18) leading to a electric consumer device (3) is soldered to each of the first cable connection (39) and the second cable connection (44).

3. A plug connector in accordance with claim 1, in which the connector housing (23) is made from plastic, and for securing said connector housing to a carrier body (26), has an S-shaped retaining tongue (29) that is insertable into a retaining opening (25) of the carrier body (26).

4. A plug connector in accordance with claim 1, in which a guard frame (51) that embraces the microtemperature fuse (19) and the coil-shaped resistor (20) in curved fashion is mounted on the connector housing (23).

5. A plug connector in accordance with claim 4, in which the connector housing (23) is made from plastic, and for securing said connector housing to a carrier body (26), has an S-shaped retaining tongue (29) that is insertable into a retaining opening (25) of the carrier body (26).

* * * * *